US006097406A

United States Patent [19]

Lubinsky et al.

[11] Patent Number: 6,097,406

[45] Date of Patent: Aug. 1, 2000

[54] APPARATUS FOR MIXING AND EJECTING MIXED COLORANT DROPS

[75] Inventors: Anthony R. Lubinsky, Penfield; Linda A. Kaszczuk, Webster; Xin Wen; David L. Cole, both of Rochester; Richard A. Landholm, Canandaigua, all of N.Y.

[73] Assignee: Eastman Kodak Company, Rochester, N.Y.

[21] Appl. No.: 09/084,617

[22] Filed: May 26, 1998

Related U.S. Application Data

[60] Provisional application No. 60/060,454, Sep. 29, 1997.

[51] Int. Cl.[7] ..... B41J 2/205

[52] U.S. Cl. ..... 347/15; 347/43; 347/68

[58] Field of Search ..... 347/15, 7, 9, 21, 347/43, 68

[56] References Cited

U.S. PATENT DOCUMENTS

| | | | |
|---|---|---|---|
| 4,022,617 | 5/1977 | McGuckin | 96/29 D |
| 4,412,885 | 11/1983 | Wang et al. | 156/643 |
| 4,555,478 | 11/1985 | Reczek et al. | 430/367 |
| 4,568,633 | 2/1986 | Lovecchio et al. | 430/367 |
| 5,011,811 | 4/1991 | Shuttleworth et al. | 503/201 |
| 5,178,190 | 1/1993 | Mettner | 137/625.65 |
| 5,238,223 | 8/1993 | Mettner et al. | 251/368 |
| 5,259,737 | 11/1993 | Kamisuki et al. | 417/322 |
| 5,364,415 | 11/1994 | Lewis | 8/406 |
| 5,367,878 | 11/1994 | Muntz et al. | 60/512 |
| 5,400,824 | 3/1995 | Gschwendtner et al. | 137/625.28 |
| 5,414,091 | 5/1995 | Chyinoporos et al. | 548/214 |
| 5,443,945 | 8/1995 | Williamson | 430/543 |
| 5,455,140 | 10/1995 | Texter et al. | 430/203 |
| 5,492,804 | 2/1996 | Biavasco et al. | 430/619 |
| 5,492,805 | 2/1996 | Krepski et al. | 430/619 |
| 5,585,069 | 12/1996 | Zanzucchi et al. | 422/100 |
| 5,611,847 | 3/1997 | Guistina et al. | 106/20 R |
| 5,679,139 | 10/1997 | McInerney et al. | 106/20 D |
| 5,679,141 | 10/1997 | McInerney et al. | 106/20 D |
| 5,679,142 | 10/1997 | McInerney et al. | 106/20 D |
| 5,698,018 | 12/1997 | Bishop et al. | 106/31.75 |

OTHER PUBLICATIONS

"Analytical Applications of a 1,10–Phenenthroline and Related Compounds," A. Schilt, Pergammon Press, 54(1969).

"Theory and Structure of Complex Compounds," P. Krumholz, Oxford:Pergamon Press, 217 (1964).

Modern Electronics Guidebook, Micahel n. Kozicki.

Understanding Microvalve Technology,26 Sensors, Sep. 1994.

Microfabricated Electrohydrodynamic Pumps, Sensors and Actuators, A21–A23 (1990) 193–197.

*Primary Examiner*—Richard Moses

*Attorney, Agent, or Firm*—Raymond L. Owens

[57] ABSTRACT

An inkjet printing apparatus for printing continuous tone images on a receiver in response to a digital image, including a structure defining a plurality of colorant or colorant precursor receiving chambers, and another structure defining at least one mixing chamber for receiving a plurality of microdrops of colorants or colorant precursors from the colorant or colorant precursor receiving chambers to produce a desired colorant. The apparatus further includes a microdrop nozzle for each receiving chamber and in communication with the mixing chamber and a printing nozzle for each mixing chamber for causing a mixed drop to be delivered to the receiver. Further, the ejection of the desired number of microdrops is controlled and in response to the digital image and connected to the receiving chamber and the mixing chamber and for causing the desired number of microdrops to be ejected into the mixing chamber and then ejecting a mixed drop of colorant from the mixing chamber through the printing nozzle to the receiver.

6 Claims, 5 Drawing Sheets

Fig. 4a
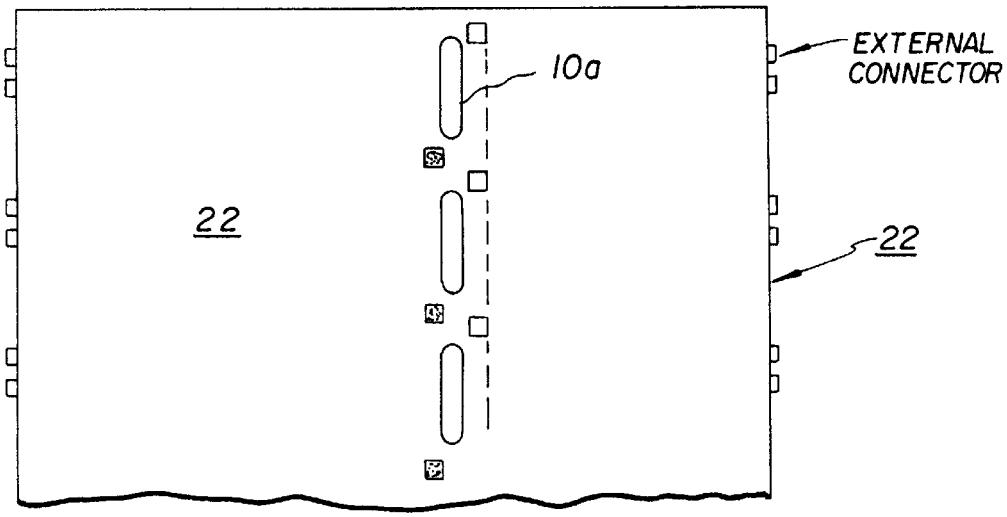
Fig. 4b
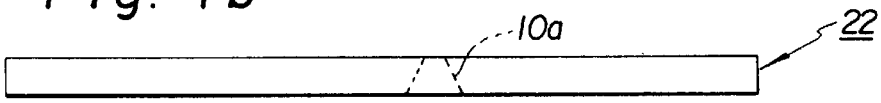
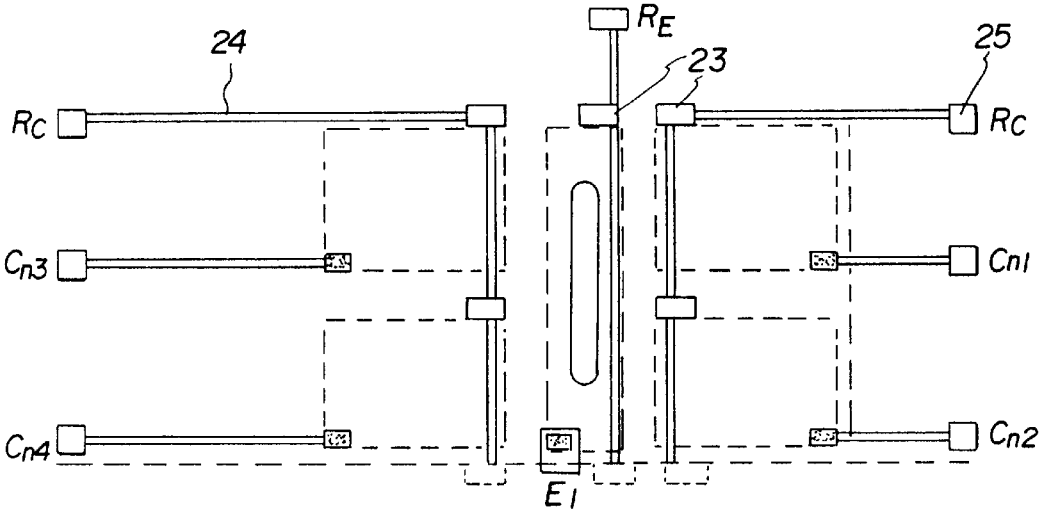
Fig. 4c

APPARATUS FOR MIXING AND EJECTING MIXED COLORANT DROPS

CROSS REFERENCE TO RELATED APPLICATIONS

The present invention is related to commonly assigned U.S. patent application Ser. No. 60/060,454 filed Sep. 29, 1997, entitled "Using Colorant Precursors and Reactants in Microfluidic Printing" to Linda A. Kaszczuk et al. The disclosure of this related application is incorporated herein by reference.

FIELD OF THE INVENTION

The present invention relates to a method of mixing accurately metered amounts of various fluids in a preparation chamber, and ejecting the prepared fluid to a second location, and more particularly to preparing a colored fluid having a particular hue and absorbance, and ejecting drops of such fluid to various locations on a receiver, so as to form a digital image.

BACKGROUND OF THE INVENTION

Ink jet printers, of both the drop-on-demand and continuous jet type, have lately enjoyed popularity in several applications, because of their good quality and relatively low hardware cost. Within the drop-on-demand category, several printing technologies have been employed including "bubble jet", in which the pressure from an expanding gas bubble in a liquid chamber causes a drop to be ejected from an orifice; and "piezo", in which the pressure pulse used for drop ejection is created by a piezoelectric actuator. However, these prior printing technologies have certain disadvantages. First, there has been no means in the prior methods by which the lightness, or optical density, of the deposited ink layer could be continuously adjusted. This then necessitates the use of digital halftoning methods, in order to render images with continuous tones, or shades.

These methods require the use of small ink droplets, high printer resolution, and complex halftoning algorithms in order to achieve images of high quality. Second, since the rate at which the printed area can be covered with ink droplets decreases as the square of the resolution (given a fixed number of nozzles and firing rate), and since high image quality requires high resolution, there has been a problem in the prior methods with slow printing speed, especially for higher quality images. Third, the amount of colorant which is carried by a liquid drop to a receiver has been limited in the prior methods by the solubility of the colorant in the liquid carrier, resulting in excessive liquid deposition, curl, long drying time, and other problems.

SUMMARY OF THE INVENTION

It is an object of the present invention to provide inkjet apparatus which solves the above problems and produces a continuous tone image.

This object is achieved by an inkjet printing apparatus for printing continuous tone images on a receiver in response to a digital image, comprising:

a) means defining a plurality of colorant or colorant precursor receiving chambers;

b) means defining at least one mixing chamber for receiving a plurality of microdrops of colorants or colorant precursors from the colorant or colorant precursor receiving chambers to produce a desired colorant;

c) means defining a microdrop nozzle for each receiving chamber and in communication with the mixing chamber and means defining a printing nozzle for each mixing chamber for causing a mixed drop to be delivered to the receiver;

d) ejecting means for controlling the operation of the microdrop nozzles for ejecting a desired number of microdrops and the printing nozzle for ejecting a mixed drop; and e) means responsive to the digital image and connected to the receiving chamber and the mixing chamber and the ejection means for causing the desired number of microdrops to be ejected into the mixing chamber and then ejecting a mixed drop of colorant from the mixing chamber through the printing nozzle to the receiver.

The present invention solves several problems with the prior art, by preparation of a continuous-tone ink jet drop in a mixing chamber, prior to ejection and deposition on a receiver. It includes one or more mixing chambers, each one is integrated with two or more microvalves. The microvalves are each capable of metering controlled amounts of fluid into the mixing chamber, at high speed. Each microvalve is fluidically connected to a reservoir which may contain colorant, fluid carrier, or various chemical reagents in order to form ink, or some other fluid to be ejected. Therefore, the speed of operation of the inkjet printing apparatus can be enhanced.

BRIEF DESCRIPTION OF THE DRAWINGS

FIGS. 4*a–c* respectively show top, side, and electrical schematics for the top cover layer of the apparatus of FIG. 2.

DETAILED DESCRIPTION OF THE PREFERRED EMBODIMENTS

Figure 1B:
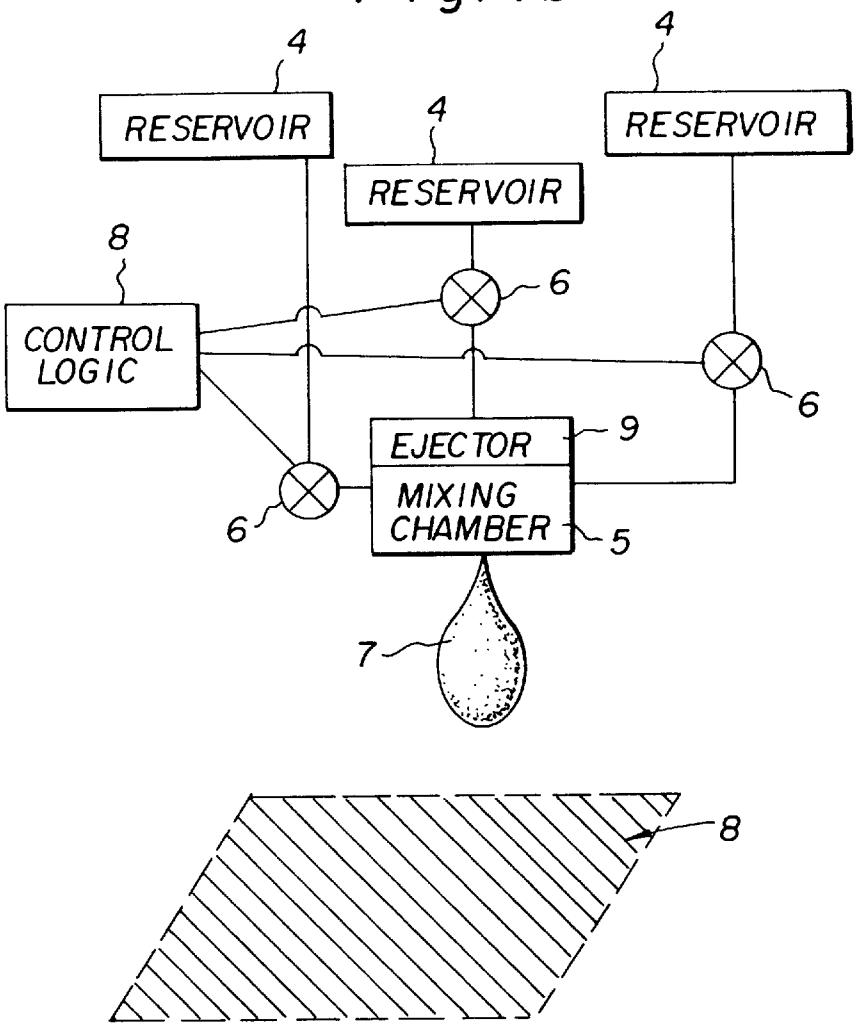
FIGS. 1*a* and 1*b* respectively show two schematics which compare the prior art (FIG. 1*a*) with the present invention (FIG. 1*b*)
Figure 1A:
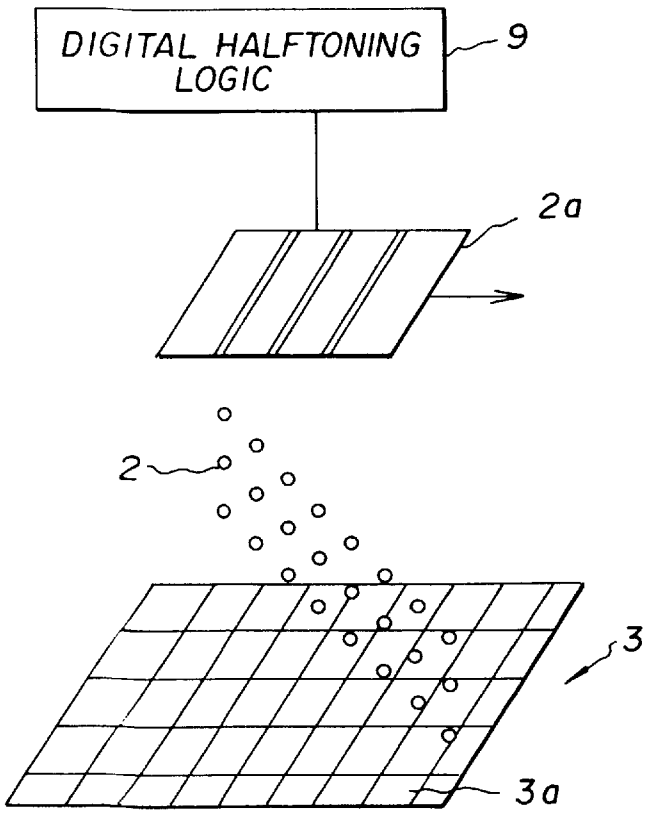
Fig. 1a PRIOR ART

FIG. 1*a* shows apparatus of a prior art way of ink jet printing and FIG. 1*b* shows a schematic of the present invention. In the prior art, a number of microdrops 2 are ejected by a printhead 2*a*, and used to print an array of micro-pixels 3*a*, which together comprise a pixel 3. The number and spatial pattern of micro-drops of each color is controlled by digital halftoning logic 9, in order that the eye/brain of the observer, in averaging over the array of micro-pixels, perceives a pixel with the desired hue, lightness, and saturation. In the present invention, predetermined amounts, as calculated by control logic 8, of various colorants, liquid carriers, or reagents contained in reservoirs 4 are metered into a mixing chamber 5, by microvalves 6, and ejected 9 as continuous-tone drops 7, which may be used to print a pixel 8. In the present invention, the hue, lightness, and saturation of the of the resultant pixel is predetermined in the mixing chamber.

Figure 2:
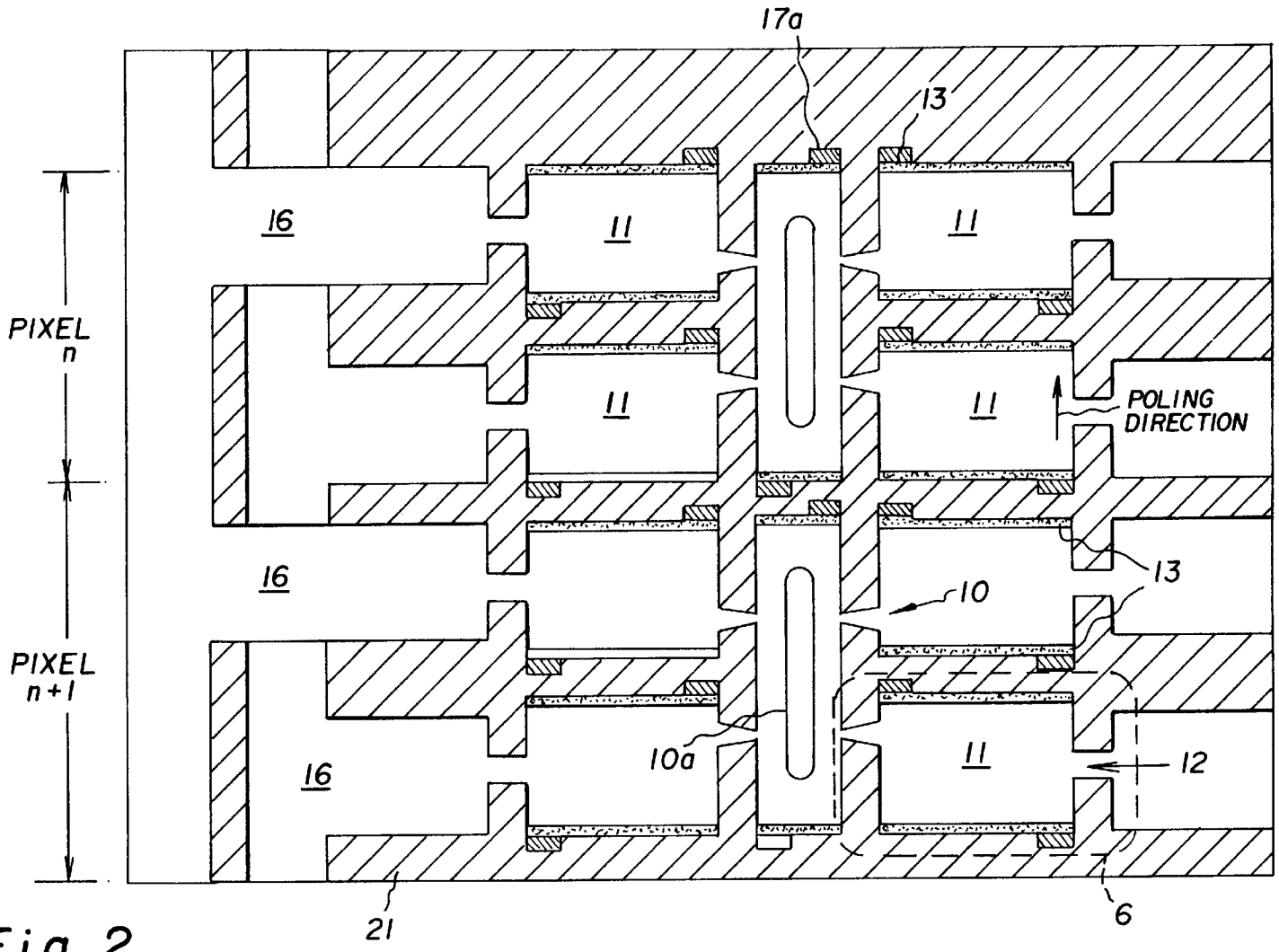
FIG. 2 shows a sectional top view of an apparatus in accordance with the present invention.
Figure 3:
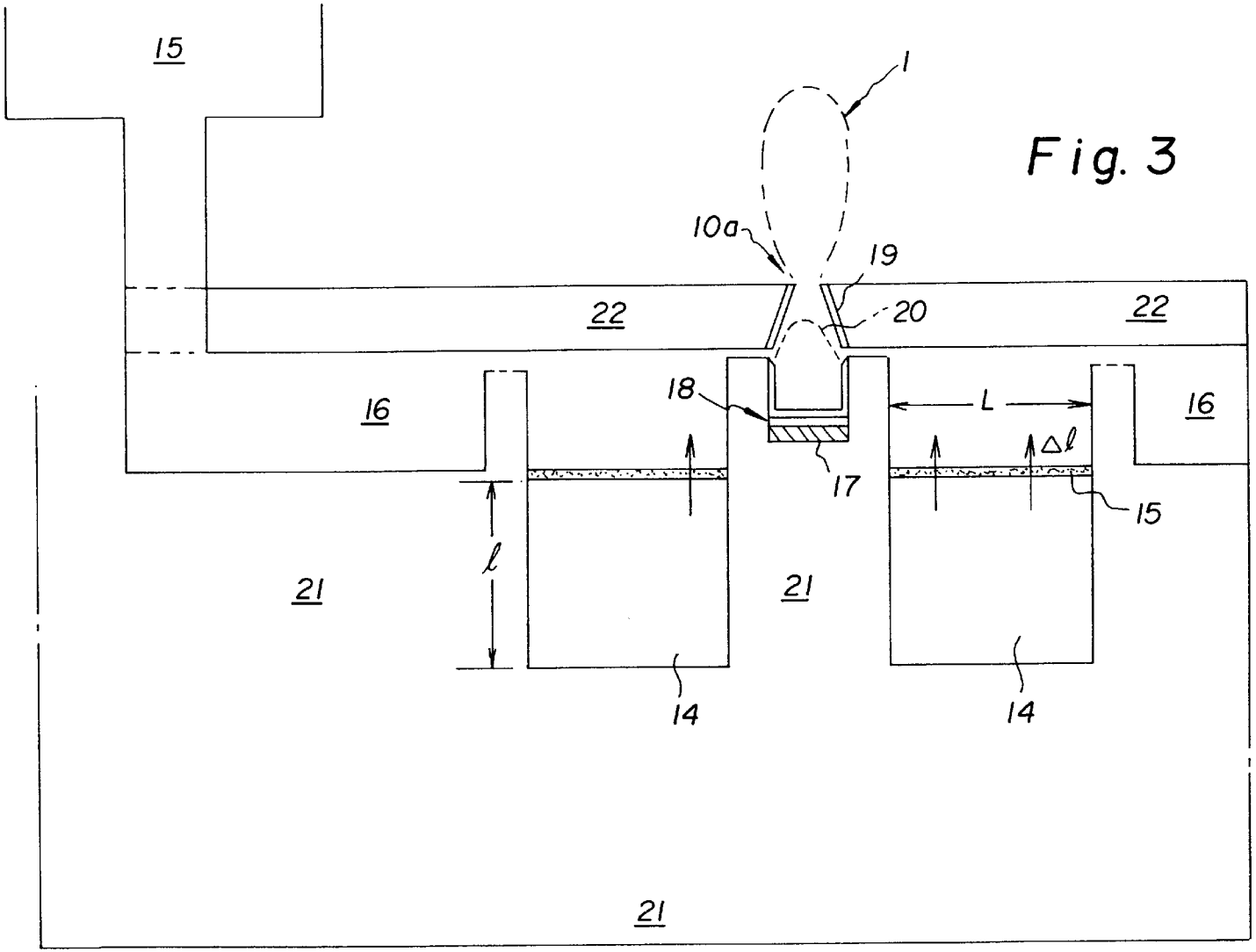
FIG. 3 is a side view of FIG. 2.

As shown in FIGS. 2 and 3 the mixing chamber 5 includes a well in a substrate material. The volume of the well is substantially equal to the volume of a mixed continuous tone ink jet drop, which may be between 2 pL and 2000 pL, and preferably between 50 pL and 500 pL. The distance between the centers of the wells in the vertical direction in FIG. 2 is equal to the printed dot pitch, which may be between 50 and 500 microns. The substrate 21 may be glass, or silicon, or a metal such as Al, or other material. If the substrate is silicon, the wells and connecting to channels in FIG. 2 may be made by standard photolithographic methods well known in the art of semiconductor device manufacturing (Modern Electronics Guidebook, Michael N. Kozicki). As the feature sizes of the wells and chambers of the present embodiment are tens to hundreds of microns, the method of manufacturing is well within the scope of present-day pattern generation technology, in Si. If the substrate is glass, the wells and connecting channels may also be made by well known methods, as, for example, spinning photoresist, masking, exposing, developing, and etching with KI (U.S. Pat. No. 5,585,069). If the substrate is Al metal, the wells and channels may again be made by known methods of plasma etching, as taught for example in U.S. Pat. No. 4,412,885.

Fluidically connected to each mixing chamber 5 are one or more microvalves 6. In the present embodiment, as shown in FIG. 2, each microvalve in turn consists of an inlet restrictor passage 12, a receiving chamber 11, a piezoelectric actuator 14 (as best seen in FIG. 3), provided with electrodes 13, and an outlet restrictor, or "microdrop nozzle" 10. The wells and fluid channels which comprise the fluid chamber and connecting passages may be formed in the substrate by the fabrication means described above. Each fluid chamber is connected via a restrictor passage to a network of pipes 16, which lead to reservoirs 15, for each colorant and/or reagent.

The piezoelectric actuator parts 14, may be made from crystalline material like Rochelle salt, or from piezoelectric ceramic material, for example PZT5H, available from Morgan Matroc, Inc., Cleveland, Ohio. The material is poled in the direction shown by the arrow in FIG. 2, and when an electric field is applied between the electrodes 13, the piezoelectric actuator part 14 responds in d31 mode in the present embodiment to produce a strain (delta 1)/1, as shown in FIG. 3. The piezoelectic part width and electrode voltage are chosen to produce an electric field in the range 0.1–1.0 volt/micron. The actuator depth 1, and the crosssectional area A, are chosen to produce, for a given material efficiency (e.g., 250×10**12 meter/volt), a volume displacement delta V=A*(delta 1) sufficient to eject a microdrop of desired volume from the mixing nozzle 10, into the mixing chamber 5. The microdrop volume is chosen appropriately for the size of the mixing chamber 5, preferably 1–20 pL. The size of the orifice of the mixing nozzle 10 is also chosen appropriately, preferably 5–25 microns.

The shape of the voltage pulses applied to the electrodes, and the relative fluid reactances of the inlet and outlet passages are chosen so as to maximize the efficiency of microdrop ejection. It should be noted that since the mixing nozzle has no stringent requirements on drop placement accuracy or on drop velocity, the design problems associated with making and operating such a nozzle are much reduced, compared to the prior printing art. Since each voltage pulse applied to the actuator electrodes results in the ejection of a single micro-drop, by varying the number of voltage pulses, the number of micro-drops and consequently the amount of fluid metered into the mixing chamber may be precisely controlled. Further, the rate at which micro-drops can be delivered into the mixing chamber is high, for example 10–100 kHz or greater, as is known from the performance of piezoelectric actuators used in the drop-on demand ink jet printing art.

Optionally, the fluid chamber 11 may be provided with a vibration plate 15, which communicates the motion of piezoelectric actuator 14, to the fluid in the chamber 11. Also, optionally, the length of the fluid chamber L, as shown in FIG. 3, may be chosen so as to cause the acoustic resonant frequency L/4*c* (where c is the velocity of sound in the fluid chamber) of the chamber 11 to equal or nearly equal the driving frequency of the voltage pulses applied to the electrodes, to optimize the efficiency of micro-drop formation.

Also, any of many other types of microvalves may be used in the present invention, as, for example, a bimetallically driven diaphragm (Understanding Microvalve Technology, 26 Sensors, September 1994), or other types as in U.S. Pat. Nos. 5,178,190; 5,238,223; 5,259,757; 5,367,878; or 5,400,824.

The mixing chamber 5 is also provided with an ejection structure. This may be a resistor layer 17, which may be of TaAl, deposited on the floor of the mixing chamber 5. An electrical passivation layer 18 of e.g., SiNi and/or SiC may be deposited over this. The resistor 17 is provided with electrodes 17*a*, which may be brought up to the top of the well, as shown in FIG. 2. Also, the entire inside surface of the mixing chamber 5 may be coated with an additional nonwetting passivation layer, which prevents fluid from sticking to the inside walls of the mixing chamber 5. After the desired amounts of the various fluids have been metered into the mixing chamber 5 and mixed, current is passed through the resistor 17 which develops an expanding gas bubble 20, which causes a mixed drop 1 to be ejected from the ejecting nozzle.

Other ejecting structures may also be used, in the present invention. For example, piezoelectric actuators, thermal bimorphs, multimorphs, or other mechanical actuators optionally in combination with mechanical levers, flippers, or catapults may be used.

Optionally, in the event that the mixing chamber is not totally clean after a cycle of fluid metering, mixing, and ejection, the first cycle may be followed by a second cycle using clear, or cleaning, fluid, to thoroughly clean the mixing chamber.

Optionally, in the event that the various fluids are not sufficiently mixed, after the above described processes of metering, nozzle flow, and ejection, the mixing chamber 5 may be provided with a micro-mechanical mixing structure, e.g. a electrohydrodynamic, or other micro-pump, as described in Microfabricated Electrohydrodynamic Pumps, Sensors and Actuators, A21-A23 (1990) 193–197.

As is shown in FIGS. 4*a*, 4*b*, 4*c*, a top cover layer 22 provided which is bonded over the substrate layer 21, and which provides a top wall for the wells and chambers shown in FIG. 2. The top layer 22 may be of glass, plastic, ceramic, or other material. The top layer 22 also has a series of orifices 10*a*, which provide the printing nozzles. These nozzles may have a tapered, or otherwise optimally designed shape, as shown in FIG. 4*b*, and may be may by stamping, drilling, laser ablation, etching, or other well known means. The top layer also carries bond pads 23 on its underside which connect with actuator electrodes 13, resistor electrodes 17*a*, and with conductive lines 24, which bring pixel electrical connections E1, RE, C1, C2, C3, C4, and RC to the exterior of the apparatus.

Figure 5:
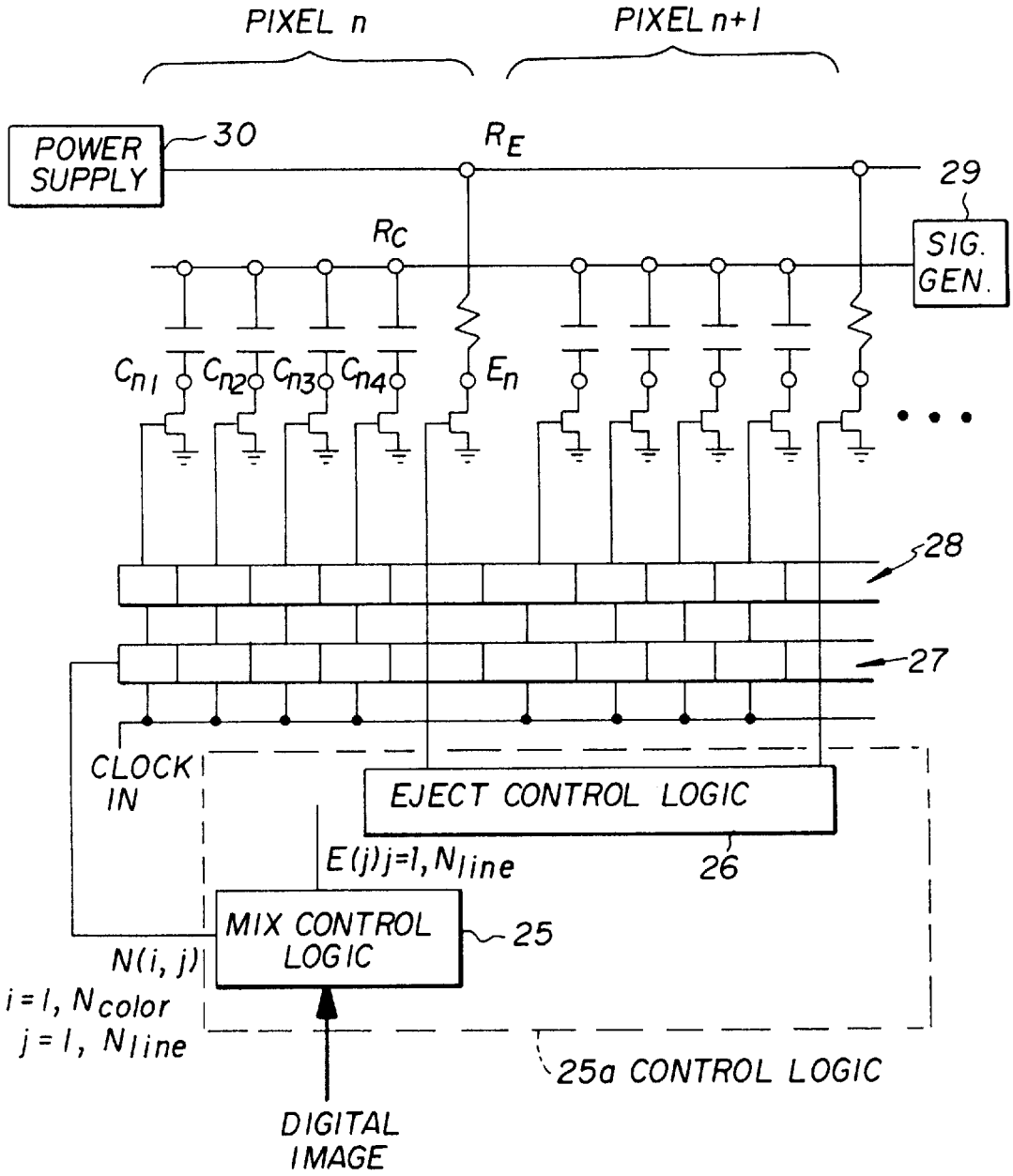
FIG. 5 shows an electrical schematic of exemplary drive electronics which can be used in accordance with the present invention used in one embodiment of the present invention.

As shown schematically in FIG. 5, there may be provided driver circuitry to control the operation of the actuating and ejecting devices. Control logic 25*a*, including mix control logic 25 receives data from the outside, and calculates the number of firing pulses to be delivered to each fluid actuator, to achieve the desired properties of the mixture, for example, hue and optical absorbance. Eject control logic 26 energizes those chambers which have received fluids, at a time after metering and mixing have finished, to eject mixed drops. If a linear array of mixing chambers 5 are used, as in a continuous tone printhead, shift register 27 and latch register 28 may be used to clock in and latch entire line of pulse data, corresponding to the various chambers in the linear array in order that all the chambers may be filled and fired, simultaneously. Signal generator 29 supplies the series of electrical pulses which drive the mixing fluid actuators, and power supply 30 supplies the electric current which drives the ejecting resistors.

Optionally, a single preparation chamber may be used, or a two-dimensional array of chambers may be used, and the driver circuitry may be modified accordingly.

The fluids which are mixed and ejected by the array of preparation chambers may include sets of colorants, as well as colorant precursors, colorant reactants, or other chemical reagents.

Examples of colorants which may be mixed to form inks may be found in U.S. Pat. Nos. 5,611,847; 5,679,139; 5,679,141; 5,679,142; 5,698,018 and in commonly assigned U.S. patent application Ser. No. 08/764,379 filed Dec. 13, 1996 by Martin. Colorants such as Ciba Geigy Unisperse Rubine 4BA-PA, Unisperse Yellow RT-PA, and Unisperse Blue GT-PA may also be used. The liquid carrier in the present invention may be water, or some other colorless or colored solvent.

In the present invention, the term colorant precursor can include, for example, colorant precursors, colorant couplers, colorant developers, ligands and leuco dyes which can react with a reactant to form the correct color species which has a desired color. This species is, of course, a colorant. The colorant precursors can be colorless or colored. The reactant can be any of wide range of chemistries. The reactant can be colored or colorless. If it is colored, a separate diluent chamber can be added to control densities. The diluent can either be a aqueous or organic solvent. The desired colors for printing are formed through the chemical reaction in the reacting chamber.

In one example, the reactant can contain metal ions which can complex with the appropriate ligands to form the colorants. The hue, saturation and lightness can be controlled by selection of the appropriate ligands to form the metal complex colorant. Examples of chemistries have been published by "Analytical Applications of a 1,10-Phenenthroline and Related Compounds", A. Schilt, Pergammon Press, 54(1969) and "Theory and Structure of Complex Compounds", P. Krumholz, Oxford: Pergamon Press, 217 (1964). These chemistries have been incorporated in conventional photographic elements as demonstrated by U.S. Pat. No. 4,555,478. Depending on the metal selected, the oxidation state of the metal can be maintained by either a reduction potential to maintain the reduced form (example $Fe^{2+}$maintained from oxidizing to $Fe^{3+}$) or by oxygen deprivation. The ligands are very soluble, allowing for very high loading in their solute. The metal complex formed becomes virtually insoluble, especially if the complexing metal is attached to an organic moiety, for example, such as described in U.S. Pat. No. 4,568,633, or a polymeric species. Ejection of the colorant drop prior to insolubilization is allowed by the short time duration in the chamber of the supersaturated solution. More specifically, as shown in Table 1, a series of ligands are shown which can react with metal ions to form colored complexes. This example is shown for illustrative purposes only and does not limit the range of possible complexations or colorants. Examples compounds that form colorants upon complexation with metal ions include hydrazones, tetrazolyl pyridines, benzimidazoles, pyridyl quinazolines, bis-isoquinolines, imines, oximes, phenanthrolines, bipyridines, terpyridines, bidiazines, pyridyl diazines, pyridyl benzimidazoles, triazines, diazyltriazines, o-nitroso anilines and phenols, tetrazines, and quinazolines, imidazoles, triazolines and thiazolines to mention a few.

TABLE 1

| Ligand | Metal Ion | Color |
|---|---|---|
| 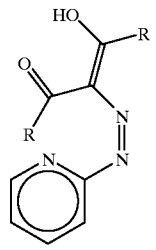 | $Ni^{2+}$ | Yellow |
| 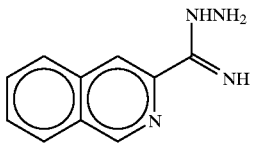 | $Fe^{2+}$ | Yellow |

TABLE 1-continued

| Ligand | Metal Ion | Color |
|---|---|---|
| 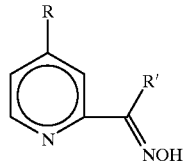 | $Fe^{2+}$ | Magenta |
| 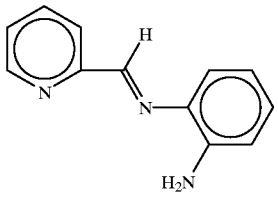 | $Fe^{2+}$ | Cyan |
| 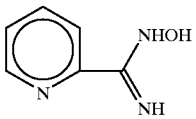 | $Fe^{2+}$ | Orange |
| 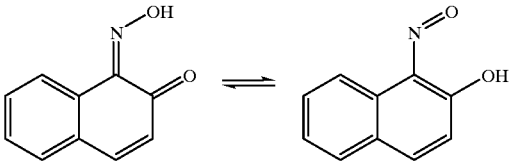 | $Fe^{2+}$ | Green |

R and R' can be H, substituted or unsubstituted alkyl, aryl cycloalkyl, aryloxy, alkoxy, heterocyclyl or vinyl groups.

The complexed structures were not drawn, but the metal chromophore visible absorption arises from a metal to ligand charge transfer transition, as detailed in the above cited references.

In other examples, reacting an electrophile with a coupler compound can form a dye. These chemistries have been successfully demonstrated in thermal printing with the in-situ formation of arylidene dyes in U.S. Pat. No. 5,011,811. More specifically, as shown in Table 2 below, there is shown a series of reactants to form colorants. In Table 2, the colorant precursors are electrophilic and the reactant is an arylidene coupler. The reaction produces dyes of the desired color.

TABLE 2

| Reactant | Colorant Precursors | Colorants (Dyes) |
|---|---|---|
| 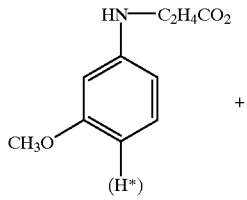 | 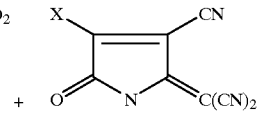 | (cyan) 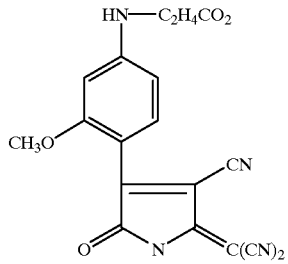 |
| A | B | E |

(magenta)

TABLE 2-continued

| Reactant | Colorant Precursors | Colorants (Dyes) |
|---|---|---|
| 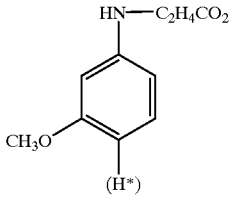 | 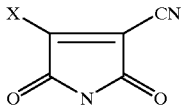 | 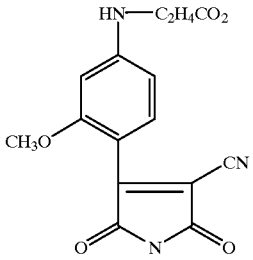 |
| A | C | F (yellow) |
| 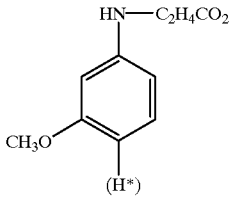 | 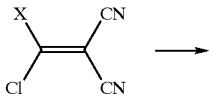 | 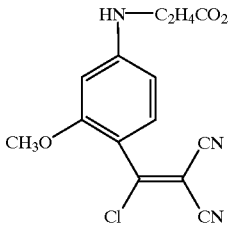 |
| A | D | G |

In another example shown in Table 3, a common electrophile reactant reacts with different colorant precursors, which, in this case, are arylidene couplers to form yellow, magenta and cyan colorants, which in this case are arylidene dyes.

TABLE 3

| Reactant | Colorant Precursors | Color (Dye) |
|---|---|---|
| 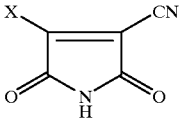 | 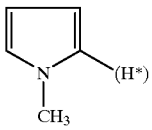 | (yellow) 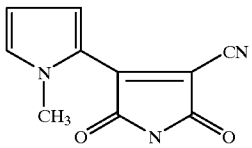 |
| C | I | J |
| 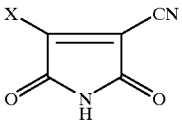 | 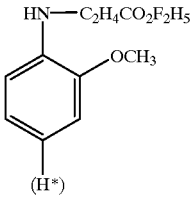 | (magenta) 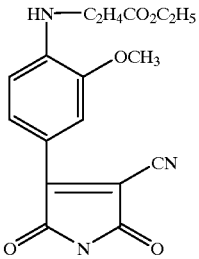 |
| C | K | L (cyan) |

TABLE 3-continued

| Reactant | Colorant Precursors | Color (Dye) |
|---|---|---|
| 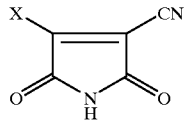 | 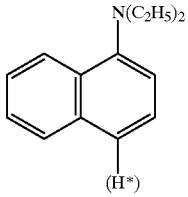 | 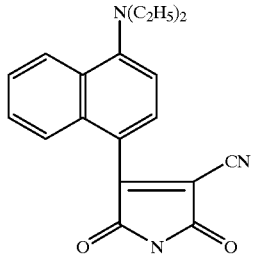 |
| C | M | N |

In accordance with the present invention, the precursor and reactant can be either the electrophile or the coupler. By using a coupler and an electrophile, the solubility limit of the half colorant molecule in the solvent will be significantly higher than that of the fully formed colorant, allowing for higher solute loading in the solvent. This in turn permitting for using less fluid, reducing the system drying constraints and costs.

In a further example, color formation can be generated by the reaction of a stable diazonium salt and a separate stable coupler. The stable diazonium component can be delivered via microfluidic pump or microvalve controlled channels to a reaction chamber to mix with a stable coupler. The reaction of diazo salt with coupler is diffusion controlled as in the earlier examples, therefore is extremely fast with high conversion.

An example of diazonium :coupler reactions to provide the primary subtractive colors of yellow, magenta and cyan is illustrated in Table 4.

TABLE 4

| Diazonium salt | Coupler | Dye | Color |
|---|---|---|---|
| 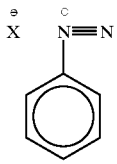 | 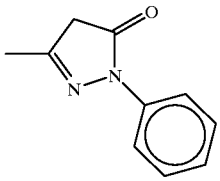 | 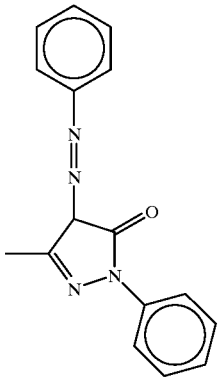 | Yellow |
| 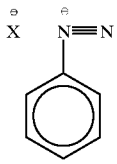 | 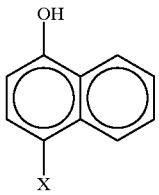 | 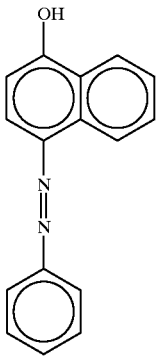 | Magenta |

TABLE 4-continued

| Diazonium salt | Coupler | Dye | Color |
|---|---|---|---|
| 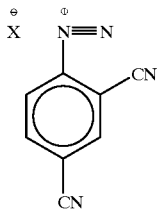 | 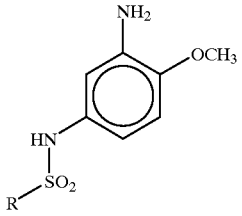 | 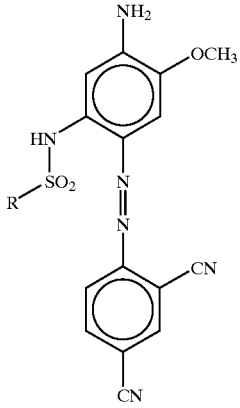 | Cyan |

X can be $BF_4^-$, a tosylate, a halide or any other salt;

R can be can be H, substituted or unsubstituted alkyl, aryl cycloalkyl, aryloxy, alkoxy, heterocyclyl or vinyl groups.

The dyes in Table 4 are examples of stable, highly colored azo dyes that can be formed in the reaction chambers.

Stable colorants can also be formed from leuco precursors in the mixing chambers to generate yellow, magenta, cyan or specialty colors. U.S. Pat. No. 4,022,617 discloses the use of leuco dyes (or leuco base dyes) in photothermographic emulsions. Additional leuco dyes that are useful include those disclosed in U.S. Pat. Nos. 5,364,415; 5,492,804; and 5,492,805. The leuco form of the dye, which typically is virtually colorless, is oxidized either by electrical potential or by metal ions to form the stable colorant. In another embodiment of this system, the oxidant (reactant) can be in the receiver element allowing the color formation to take place after drop ejection on the receiver. In this case the mixing chamber is used to pre-mix the proper balance of leuco dyes (i.e. C, M and Y) to then be delivered to the receiver. Table 5 provides practical examples.

TABLE 5

| Leuco Form | Oxidant | Color |
|---|---|---|
| 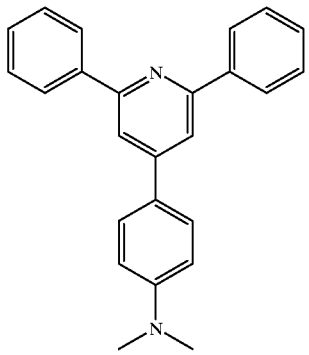 | $Zn^{2+}$ | Yellow |

TABLE 5-continued

| Leuco Form | Oxidant | Color |
|---|---|---|
| 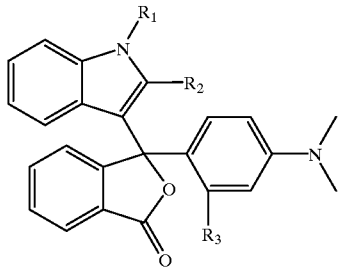 | $Zn^{2+}$ | Cyan |

$R_1$, $R_2$ and $R_3$ can be can be H, substituted or unsubstituted alkyl, aryl cycloalkyl, aryloxy, alkoxy, heterocyclyl or vinyl groups.

It is understood that the above description is only intended to be an example of many possible chemistries that can be used in the present invention. For example, the chemistries disclosed in U.S. Pat. Nos. 5,414,091; 5,443,945; and 5,455,140 can be incorporated into the present invention. Other examples of related chemical systems can be found in "Analytical Applications of a 1,10-Phenenthroline and Related Compounds", A. Schilt, Pergammon Press, 54(1969) and "Theory and Structure of Complex Compounds", P. Krumholz, Oxford: Pergamon Press, 217 (1964). Furthermore, the colors formed by the colorant precursors are also not limited by the above examples. For instance, red, green, blue, orange or violet colorant precursors can also be included to form the respective colors, as disclosed by example in U.S. Pat. No. 5,011,811.

The invention has been described in detail with particular reference to certain preferred embodiments thereof, but it will be understood that variations and modifications can be effected within the spirit and scope of the invention.

What is claimed is:

1. An inkjet printing apparatus for printing continuous tone images on a receiver in response to a digital image, comprising:

a) means defining a plurality of colorant or colorant precursor receiving chambers;

b) means defining at least one mixing chamber for receiving a plurality of microdrops of colorants or colorant precursors from the colorant or colorant precursor receiving chambers to produce a desired colorant;

c) means defining a microdrop nozzle for each receiving chamber and in communication with the mixing chamber and means defining a printing nozzle for each mixing chamber for causing a mixed drop to be delivered to the receiver;

d) ejecting means for controlling the operation of the microdrop nozzles for ejecting a desired number of microdrops and the printing nozzle for ejecting a mixed drop; and e) means responsive to the digital image and connected to the receiving chamber and the mixing chamber and the ejection means for causing the desired number of microdrops to be ejected into the mixing chamber and then ejecting a mixed drop of colorant from the mixing chamber through the printing nozzle to the receiver.

2. The apparatus of claim 1 wherein the ejecting means includes a piezoelectric actuator for operating the microdrop nozzle and means for operating the printing nozzle for causing a mixed drop of colorant to be delivered to the receiver.

3. The apparatus of claim 2 wherein the printing nozzle operating means includes an electric resistor responsive to the digital image responsive means which causes heat and bubble formation in the mixing chamber to permit a mixed drop of colorant to be ejected.

4. The apparatus of claim 2 includes a second piezoelectric actuator.

5. The apparatus of claim 1 wherein the ejecting means includes means for operating the microdrop nozzle and printing actuator means for operating the printing nozzle for causing a mixed drop of colorant to be delivered to the receiver.

6. The apparatus of claim 5 wherein the digital image responsive means includes logic for calculating the number of microdrops to be ejected and for controlling the operation of the microdrops operating means and the printing actuator means.

* * * * *